United States Patent [19]

Kennedy et al.

[11] 4,298,871

[45] Nov. 3, 1981

[54] DESIRED SIGNAL ESTIMATOR FOR NULL STEERER FM RECEPTION USING FSK MODULATION

[75] Inventors: Peter D. Kennedy, Mesa; Gregory H. Piesinger, Scottsdale, both of Ariz.

[73] Assignee: Motorola Inc., Schaumburg, Ill.

[21] Appl. No.: 47,610

[22] Filed: Jun. 11, 1979

Related U.S. Application Data

[63] Continuation-in-part of Ser. No. 910,935, May 30, 1978, abandoned.

[51] Int. Cl.[3] ..... H01Q 3/26

[52] U.S. Cl. ..... 343/100 SA

[58] Field of Search ..... 343/100 SA, 100 LE

[56] References Cited

U.S. PATENT DOCUMENTS

| | | | |
|---|---|---|---|
| 4,079,379 | 3/1978 | Piesinger | 343/100 SA |
| 4,079,380 | 3/1978 | Esry et al. | 343/100 SA |
| 4,152,702 | 5/1979 | Piesinger | 343/100 SA |
| 4,156,877 | 5/1979 | Piesinger | 343/100 SA |
| 4,214,244 | 7/1980 | McKay et al. | 343/100 SA X |

*Primary Examiner*—T. H. Tubbesing

*Attorney, Agent, or Firm*—Eugene A. Parsons

[57] ABSTRACT

In a communications system including a transmitter and a receiver with a multiple antenna array having null steering apparatus attached thereto, a desired signal and an identifier signal are summed and utilized to frequency-shift key (FSK) modulate a carrier prior to transmission, the desired signal including bits of data delayed a predetermined period relative to the identifier signal and the identifier signal including the bits of data summed with a pseudo random signal and substantially reduced in amplitude relative to the desired signal, which transmitted signal is received in the null steering apparatus where the pseudo random signal is removed from the identifier signal and the data is utilized to FSK modulate a carrier to produce a reference signal, which reference signal is utilized to cause the null steering apparatus to have high response to the desired signal.

7 Claims, 4 Drawing Figures

DESIRED SIGNAL ESTIMATOR FOR NULL STEERER FM RECEPTION USING FSK MODULATION

This is a continuation-in-part of application Ser. No. 910,935, filed May 30, 1978, now abandoned.

BACKGROUND OF THE INVENTION

Null steering or adaptive noise cancelling is a procedure which has been known for many years and is described, for example, in such typical articles as "Adaptive Antenna Systems", by B. Widrow et al., Proceedings of the IEEE, Volume 55, No. 12, December 1967, and "Adaptive Noise Cancelling: Principles and Applications", by B. Widrow et al., Proceedings of the IEEE, Volume 63, No. 12, December 1975. In general, null steering is a technique whereby two or more antenna signals are weighted and summed together to form a composite antenna pattern. The pattern is formed in such a manner as to create antenna pattern nulls in the directions of the jamming signals and lobes in the direction of desired signals. Using null steering techniques, nulls on the order of 50 dB below the pattern maxima can be automatically steered in the directions of jamming signals.

Using, for example, a four channel null steerer, each antenna signal is split into an in-phase component and a quadrature component with a 90 degree hybrid circuit or the like. The two signal components are then weighted and summed together along with the signal components from the other antenna weighters, in a final summing circuit. By using a 90 degree hybrid circuit and weighters, a single phasor (any specific signal on an antenna can be represented by a phasor) on a particular antenna can be shifted to any new phase and amplitude desired. If a jamming signal or any other undesired signal is presented on two antennas, for example, the null steerer will shift the two signals (phasors) such that they are of equal amplitude and opposite phase. When these two weighted signals are then summed together in the final summing circuit, they will cancel, thereby forming an antenna pattern null in the direction of the jamming signal. The process is similar when the jamming signal is present on all four antennas. The number of independent nulls that can be formed is equal to N-1 where N is the number of antennas.

The value of each weight is automatically adjusted by feeding back the output of the final summing circuit to a correlator or mixer, which mixes the summing circuit output with the signal component from the corresponding antenna, which is non-weighted, thereby creating a correlation voltage. This correlation voltage is integrated and used to drive the specific weighter for that antenna component. The weighters are always driven in such a manner as to minimize the feedback signal. When the feedback signal is completely eliminated, corresponding to forming a complete null, the output of the correlator is zero and the system has fully adapted. A null steerer implemented in this manner will null out all signals as long as the number of signals is equal to or less than N-1.

In one commonly used technique for preventing nulling of desired signals, a reference signal is used. U.S. Pat. No. 4,079,379, entitled "Null Steering Apparatus For a Multiple Antenna Array", issued Mar. 14, 1978, and assigned to the same assignee, describes apparatus for providing such a reference signal. A copending application entitled "Adaptive Antenna Lobing on Spread Spectrum Signals At Negative S/N", Ser. No. 877,133, now U.S. Pat. No. 4,152,702, Feb. 13, 1978 and assigned to the same assignee, also describes apparatus for providing such a reference signal. However, this apparatus actually transmits two RF signals 90 degrees out of phase. A technical report from the Ohio State University Research Foundation, entitled "An Adaptive Array For Interference Rejection in a Coded Communication System", by K. L. Reinhard, dated May, 1972, discloses apparatus for producing such a reference signal from the output of the processor. The major difficulty with this apparatus is the fact that the reference signal is not in phase with the desired signal and, therefore, the operation of the null steering apparatus lags the reception of the desired signal resulting in a reduction of the signal to noise ratio in the waveform processor.

SUMMARY OF THE INVENTION

The present invention pertains to a communications system including apparatus for transmitting an FSK signal comprising a carrier modulated with a desired signal and an identifier signal; the desired signal including bits of data delayed a predetermined period relative to the identifier signal and the identifier signal including the bits of data combined with a pseudo random signal and substantially reduced in amplitude relative to the desired signal; and apparatus for reception of the transmitted signal including a multiple antenna array having connected thereto null steering apparatus with a feedback path and circuitry for separating the identifier signal from the desired signal, delaying the identifier signal a predetermined amount, removing the pseudo random signal, and modulating a carrier with the remainder of the identifier signal to produce a reference signal, in phase with and substantially identical to the desired signal, which is then utilized to adjust the null steering apparatus to form a lobe in the antenna pattern in the direction of the desired signal.

It is an object of the present invention to provide new and improved null steering apparatus for use in conjunction with a multiple antenna array in communications system.

It is a further object of the present invention to provide apparatus for producing a reference signal in null steering apparatus which is substantially a duplicate of the desired signal and which is in phase with the desired signal so as to eliminate the reduction of the signal to noise ratio in the apparatus.

These and other objects of this invention will become apparent to those skilled in the art upon consideration of the accompanying specification, claims and drawings.

DESCRIPTION OF THE DRAWINGS

Referring to the drawings.

DESCRIPTION OF THE PREFERRED EMBODIMENT

Figure 1:
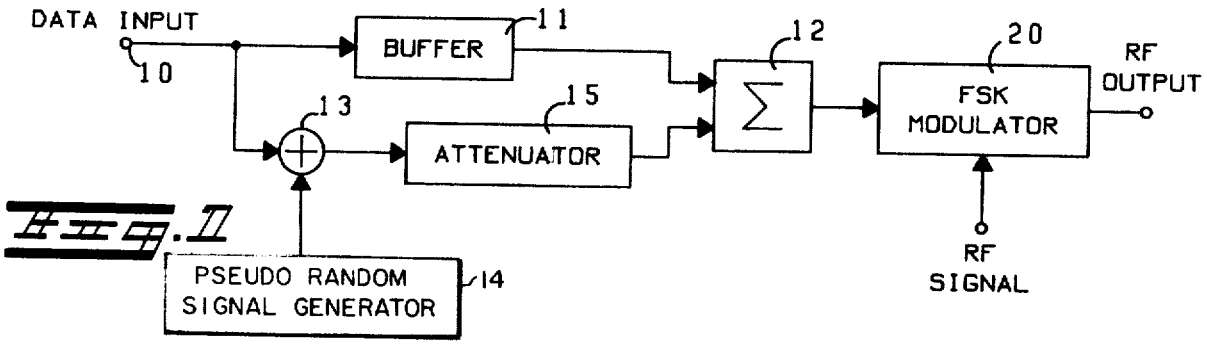
FIG. 1 is a simplified block diagram of transmission apparatus for use in a communications system embodying the present invention.

Referring specifically to FIG. 1, a simplified block diagram of transmitting apparatus is illustrated. The numeral 10 designates an input terminal adapted to receive a signal desired to be communicated to a distant receiver, which signal is in the form of bits of data. The input terminal 10 is connected to a buffer 11, which is designed to delay the data applied thereto a predetermined amount which may be, for example, the time corresponding to one or more bits. The amount of delay required in the buffer 11 will become apparent during the description of the receiver apparatus. The delayed data from the buffer 11 is connected to one input of a summing device 12. The data applied to the input terminal 10 is also connected directly to a combining device 13, which may be a modulo 2 adder or the like. The combining device 13 also has an input adapted to receive a pseudo random signal from the pseudo random signal generator 14 for scrambling the data signal so that it cannot be easily duplicated for jamming and the like. In this embodiment the data and the pseudo random signal are at approximately the same bit rate so that the output of the combining device 13 is simply a scrambled signal, rather than a spread spectrum signal. This ouput signal is then applied through an attenuator 15 to a second input of the summing device 12. The attenuator 15 reduces the amplitude of the signal from the combining device 13 to a low level with respect to the data signal at the output of the buffer 11 so that its presence will only slightly degrade the bit error rate of the data signal. The signal at the output of the attenuator 15 forms an identifier signal while the signal at the output of the buffer 11 is the desired signal. The two signals are summed in the summing device 12 and applied to an FSK modulator 20 to modulate an RF signal which is then transmitted in the normal fashion.

Figure 2:
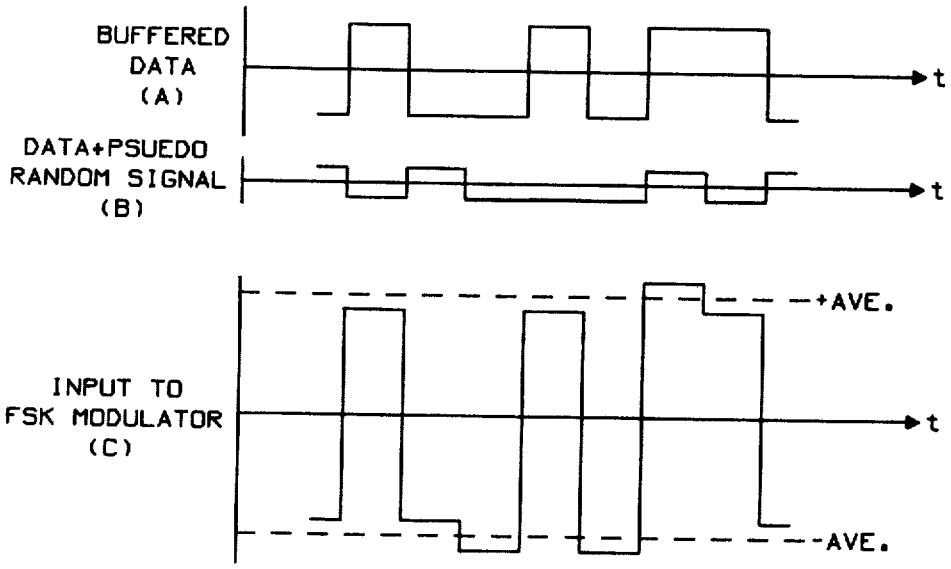
FIG. 2 illustrates several typical waveforms present in the transmission apparatus of FIG. 1.

Referring specifically to FIG. 2, the waveform A is a typical representation of the delayed bits of data available at the output of the buffer 11. The waveform B is a typical representation of the data plus the pseudo random signal at the output of the attenuator 15. The waveform C is representative of the waveforms A and B added in the summing device 12 to produce a four level signal. It should of course be understood that these signals are only representative and are illustrated for purposes of this description.

Figure 3:
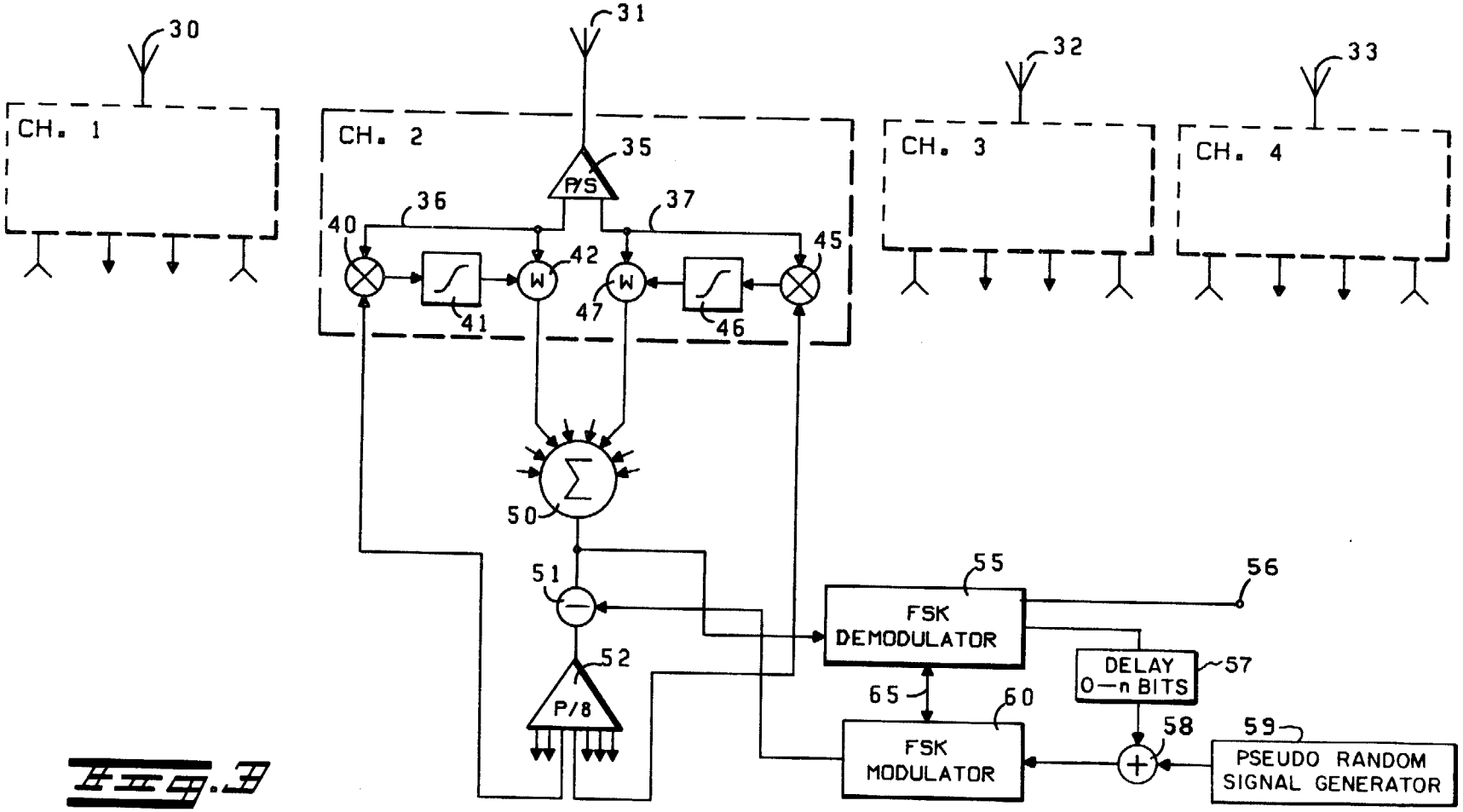
FIG. 3 illustrates a simplified block diagram of a multiple antenna array having null steering apparatus connected thereto which embodies the present invention.

Referring specifically to FIG. 3, a multiple antenna array is illustrated, consisting of four antennas designated 30–33. Any specific signal on any one of the antennas 30–33 can be represented by a phasor and each antenna has associated therewith electronics, designated channel 1 through channel 4, for manipulating the signal so that each phasor, after weighting, has substantially any desired amplitude and phase. Each of the channels 1 through 4 is identical to the others. Only channel 2 will be described in detail and it should be understood that each of the remaining channels operates in a similar fashion and contains similar apparatus. It should also be understood that the apparatus illustrated is only exemplary of one type of apparatus providing null steering and those skilled in the art may devise other apparatus which will operate to provide the null steering function, which apparatus is within the scope of this invention.

A 90 degree hybrid, or phase splitter, 35 is connected to receive the signals from antenna 31 and supply in-phase and quadrature components thereof on lines 36 and 37, respectively. It should be understood that circuitry can be interposed between the antennas and the phase splitters to alter the frequency of the incoming signal, e.g., as commonly done in superheterodyne receivers. The line 36, transmitting the in-phase component, is connected to one input of a correlator, which may be a mixer or multiplier 40, that provides a signal at a output thereof which is representative of the correlation between the signal applied from the line 36 and a signal applied to a second input of the correlator 40. Output signals from the correlator 40 are integrated in an integrator 41 and applied to a control input of a weighting circuit 42, the signal input of which is connected to the line 36. The weighting circuit 42 may be for example, a variable amplifier or attenuator wherein the signal from the integrator 41 adjusts the amplification or attenuation applied to the signal passing through the weighting circuit 42 from the line 36 and the phase can be changed 0 degrees or 180 degrees also. In a similar fashion, the line 37 is connected to one input of a correlator 45, which correlator 45 has an output connected through an integrator 46 to the control input of a weighting circuit 47. The weighting circuit 47 also has its signal input connected to the line 37. The correlator 45, integrator 46 and weighting circuit 47 are substantially identical to the correlator 40, integrator 41 and weighting circuit 42, respectively.

The outputs of the weighting circuits 42 and 47, as well as similar outputs from channels 1, 3 and 4, are applied to a summing circuit 50. The summing circuit 50 has a single output which is connected to one input of a subtractor circuit 51 with a single output which is applied through a power splitter 52 to each of the second inputs of the correlators 40, 45, and the two correlators in each of the channels 1, 3 and 4. The output of the summing circuit 50 is connected to an input of an FSK demodulator 55. The demodulator 55 has a first output 56 which supplies the data, or desired signal, to the remainder of the circuitry (not shown) and a second output which supplies the identifier signal to a delay 57, which in turn supplies the identifier signal to a combining device 58. A pseudo random signal generator 59, which produces a pseudo random signal similar to the signal applied to the combining device 13 in the transmitter, is connected to a second input of the combining device 58. An output of the combining device 58 is connected to an FSK modulator 60 and the output thereof is connected to a second input of the subtractor 51. A connection 65 between the demodulator 55 and the modulator 60 maintains the two circuits operating at the same carrier frequency.

In the operating of the specific embodiment illustrated, the feedback loop of the null steerer operates in the manner previously described. The components 55, 58 and 60 cooperate to produce a reference signal from the identifier signal which is then utilized in the feedback loop to prevent nulling of the desired signal. The data signal, present at the output terminal 56, is recovered with the FSK demodulator 55 using standard discriminator/integrate and dump techniques. Since the identifier signal was added at a low level with respect to the data signal in the summing device 12 of the transmitter, its presence only slightly degrades the bit error rate of the data signal.

In this embodiment the desired signal is delayed one bit relative to the identifier signal in the transmitting apparatus of FIG. 1. When the identifier signal is separated in the demodulator 55 by integrate and dump techniques the identifier signal is delayed one bit, as will be understood by those skilled in the art. This "built-in" delay will bring the reference signal generated at the output of the modulator 60 into phase with the desired signal in those instances where a delay of one bit is sufficient. In some instances more delay may be desired in the buffer 11 of the transmitter and, if normal delay in the receiver is not sufficient, additional delay means, as exemplified by delay 57 of the present embodiment, may have to be introduced in the receiver to bring the reference signal into phase with the desired signal. In any case the delay in the receiver should be such as to bring the reference signal as closely into phase with the desired signal as is possible or practical, ranging from 0 bits in the delay means where the normal delay is sufficient up to n bits where the normal delay is insufficient to the extent of n bits. Typical delay means utilized may be, for example, any binary counter, flip-flops, etc. Further, while the identifier signal is delayed in the demodulator 55 of the present embodiment it should be understood that the delay could be introduced anywhere that it is convenient, subsequent to the separation and prior to the application of the reference signal to the subtractor 51.

Figure 4:
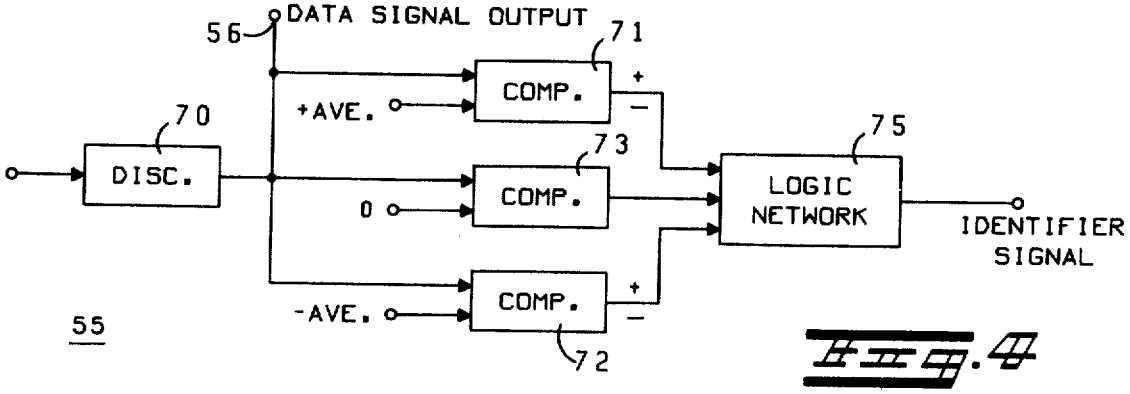
FIG. 4 is a simplified block diagram of a FSK demodulator for use in the system of FIG. 3.

Referring specifically to FIG. 4, a possible implementation of the FSK demodulator 55 is shown. The input signal from the final summer 50 is applied to a discriminator 70, which may utilize the standard integrate and dump techniques to provide a four level signal at the output thereof. The output of the discriminator is a waveform similar to the waveform illustrated in FIG. 2*c* and can be applied directly to the terminal 56 as the data output signal. The four level output signal of the discriminator 70 is also applied to an input of a first comparator 71, a second comparator 72, and a third comparator 73. A second input of the comparator 71 has a positive average voltage applied thereto which is approximately midway between the upper and lower levels of the positive pulses illustrated in FIG. 2*c* (the difference between a positive and a negative identifier pulse applied to a positive data signal). A second terminal of the comparator 72 has a negative average voltage applied thereto, which is approximately midway between the upper and lower levels of the negative pulses in FIG. 2*c* (the difference between a positive and negative identifier pulse applied to a negative data pulse). A second terminal of the comparator 73 has zero voltage applied thereto. An output of the comparator 71, an output of the comparator 72, and an output of the comparator 73 are connected to a logic network, 75, the output of which is the recovered identifier signal. The positive average and negative average voltages are indicated in FIG. 2*c* in dotted lines to illustrate their relationship to the four level signal.

To briefly describe the operation of the exemplary circuit illustrated in FIG. 4, if the four level signal is above the positive average voltage the comparator 71, the comparator 72, and the comparator 73 provide positive outputs. The logic network 75 provides a positive output with this combination of inputs, corresponding to the positive value of the identifier signal. If the four level signal is below the positive average voltage and above zero the comparator 71 provides a negative output, and the comparator 72 and the comparator 73 provide positive outputs. The logic network 75 provides a negative output with this combination of inputs, corresponding to the negative value of the identifier signal. If the four level signal is above the negative average voltage and below zero, the comparator 71 and the comparator 73 provide negative outputs, and the comparator 72 provides a positive output. The logic network 75 provides a positive output with this combination of inputs, corresponding to the positive value of the identifier signal. If the four level signal is below the negative average voltage the comparator 71, the comparator 72, and the comparator 73 provide negative outputs. The logic network 75 provides a negative output with this combination of inputs, corresponding to the negative value of the identifier signal. It should be understood that the particular circuit illustrated in FIG. 4 is only used because of its simplicity and to explain the operation of the circuit, and those skilled in the art may devise other circuits for recovering the identifier signal from the demodulated four level signal.

The recovered identifier signal is added to the internally generated pseudo random signal in the combining circuit 58 (which may be a modulo 2 adder) to substantially recover (or predict) the original data signal. This signal is then used to drive the FSK modulator 60 which produces a reference signal for application to the subtractor 51. The center frequency of the FSK modulator 60 is locked to the center frequency of the FSK demodulator 55 using phase locked loop, matched modulator demodulator, or other techniques. Thus, the identifier signal is recovered and unscrambled to form a replica of the data signal which replica is similar to the desired signal in content and in phase. Using this replica, the data signal is subtracted from the feedback path. The identifier signal is not subtracted, but its energy is small compared to the data signal energy. Since the majority of energy in the desired signal is subtracted, a lobe will be formed on the desired signal instead of a null. Because the reference signal is in-phase with the desired signal the signal to noise ratio in the system is maintained relatively high.

While we have shown and described a specific embodiment of this invention further modifications and improvement will occur to those skilled in the art. We desire it to be understood, therefore, that this invention is not limited to the particular form shown and we intend in the appended claims to cover all modifications which do not depart from the spirit and scope of this invention.

What is claimed is:

1. In a multiple antenna array, null steering apparatus for reception of a desired signal wherein an identifier signal is transmitted with the desired signal, the desired signal including bits of data delayed a predetermined period relative to the identifier signal and the identifier signal including the bits of data summed with a pseudo random signal and substantially reduced in amplitude relative to the desired signal, said desired signal and said identifier signal being summed and utilized to FSK modulate a carrier prior to transmission, said null steering apparatus comprising:

(a) feedback means associated with each antenna in said array for adjusting the amplitude and phase of signals therein so that unwanted signals from the array are cancelled;

(b) demodulation means, including normal delay, coupled to said feedback means for removing the carrier and separating the desired signal from the identifier signal;

(c) pseudo random signal generating means for providing an output signal substantially similar to the pseudo random signal in the transmission;

(d) combining means coupled to the demodulation means for receiving the identifier signal and coupled to the generating means for subtracting the pseudo random signal from the identifier signal;

(e) delay means incorporated into said apparatus, in addition to said normal delay in said demodulation means, for delaying the separated identifier signal sufficient to bring the identifier signal substantially into phase with the desired signal; and (f) modulation means coupled to said combining means and said feed back means for receiving the delayed bits of data remaining in said identifier signal and FSK modulating a carrier therewith to supply a reference signal substantially in phase with the desired signal to said feedback means to form a lobe in the antenna pattern in the direction of the desired signal.

2. Null steering apparatus as claimed in claim 1 wherein the bits of data of the desired signal and the pseudo random signal have approximately similar bit rates and the combining means is the modulo 2 adder.

3. A communications system comprising:

(a) a transmitter for transmitting a desired signal and an identifier signal, simultaneously, said transmitter including:

(1) input means for receiving bits of data and providing a data output and including delay means for delaying the bits of data a predetermined amount and providing a delayed data output as a desired signal, (2) pseudo random code generating means providing a predetermined pseudo random code, (3) combining and attenuating means coupled to the data output of said input means and said generating means for combining the bits of data and the pseudo random code to form the identifier signal reduced in amplitude a predetermined amount, (4) summing means connected to receive the delayed data output from said input means and the identifier signal from said combining and attenuating means and provide a single output signal, and (5) FSK modulating means coupled to said summing means and to a source of RF carrier signal for providing an FSK modulated carrier for transmission; and (b) a receiver having a multiple antenna array connected thereto for receiving the FSK modulated carrier from said transmitter, said receiver including:

(1) feedback means associated with each antenna in the array for adjusting the amplitude and phase of signals therein so that unwanted signals from the array are cancelled, (2) demodulation means, including normal delay, coupled to said feedback means for removing the carrier and separating the desired signal from the identifier signal, (3) pseudo random signal generating means for providing an output signal substantially similar to the pseudo random signal in the transmission, (4) combining means coupled to the demodulation means for receiving the identifier signal and coupled to the generating means for subtracting the pseudo random signal from the identifier signal, (5) delay means incorporated into said apparatus, in addition to said normal delay in said demodulation means, for delaying the separated identifier signal sufficient to bring the identifier signal substantially into phase with the desired signal; and (6) modulation means coupled to said combining means and said feedback means for receiving the delayed bits of data remaining in said identifier signal and FSK modulating a carrier therewith to supply a reference signal substantially in phase with the desired signal to said feedback means to form a lobe in the antenna pattern in the direction of the desired signal.

4. A communications system as claimed in claim 3 wherein the bits of data of the desired signal and the pseudo random signals have approximately similar bit rates and the combining means are modulo 2 adders.

5. In conjunction with a multiple antenna array having attached thereto null steering apparatus for reception of a desired signal having an identifier signal transmitted therewith, the desired signal including bits of data delayed a predetermined period relative to the identifier signal and the identifier signal including the bits of data summed with a pseudo random signal and substantially reduced in amplitude relative to the desired signal, said desired signal and said identifier signal being summed and utilized to FSK modulate a carrier prior to transmission, a method of null steering the array comprising the steps of:

(a) demodulating the carrier, separating the desired signal and the identifier signal, and delaying said identifier signal by an amount normal for said demodulating;

(b) removing the pseudo random signal from the identifier signal;

(c) delaying the separated identifier signal, in addition to said delaying normal for said demodulating, sufficient to bring the identifier signal substantially into phase with the desired signal;

(d) FSK modulating a carrier with the remaining delayed identifier signal to produce a reference signal;

and (e) utilizing the reference signal to adjust the null steering apparatus to form a lobe in the antenna pattern in the direction of the desired signal.

6. A method as claimed in claim 5 wherein the bits of data of the desired signal and the pseudo random signal have approximately the same bit rate and are combined and removed by modulo 2 adding.

7. In a communications system including a transmitter and a receiver with a multiple antenna array having null steering apparatus attached thereto with feedback circuitry for directing nulls in the array pattern in the direction of unwanted signals, a method of directing a lobe in the array pattern in the direction of a desired signal comprising the steps of:

(a) transmitting an FSK signal including a carrier modulated with a desired signal and in identifier signal, the desired signal including bits of data delayed a predetermined period relative to the identifier signal and the identifier signal including the bits of data combined with a pseudo random signal and substantially reduded in amplitude relative to the desired signal;

(b) receiving the transmitted signal in the receiver;

(c) demodulating the carrier and separating the desired signal and the identifier signal, and delaying said identifier signal by an amount normal for said demodulating;

(d) removing the pseudo random signal from the identifier signal;

(e) delaying the separated identifier signal, in addition to said delaying normal for said demodulating, sufficient to bring the identifier signal substantially into phase with the desired signal;

(f) FSK modulating a carrier with the remaining delayed identifier signal to produce a reference signal;

and (g) utilizing the reference signal to adjust the null steering apparatus to form a lobe in the antenna pattern in the direction of the desired signal.

* * * * *